US006394760B1

(12) United States Patent
Tell

(10) Patent No.: US 6,394,760 B1
(45) Date of Patent: May 28, 2002

(54) VACUUM EJECTOR PUMP

(75) Inventor: Peter Tell, Åkersberga (SE)

(73) Assignee: Piab AB, Taby (SE)

( * ) Notice: Subject to any disclaimer, the term of this patent is extended or adjusted under 35 U.S.C. 154(b) by 0 days.

(21) Appl. No.: 09/646,603

(22) PCT Filed: Mar. 12, 1999

(86) PCT No.: PCT/SE99/00386

§ 371 (c)(1),
(2), (4) Date: Sep. 20, 2000

(87) PCT Pub. No.: WO99/49216

PCT Pub. Date: Sep. 30, 1999

(30) Foreign Application Priority Data

Mar. 20, 1998 (SE) ..... 9800943

(51) Int. Cl.[7] ..... F04F 5/00
(52) U.S. Cl. ..... 417/174
(58) Field of Search ..... 417/174, 163, 417/165, 166, 168, 169

(56) References Cited

U.S. PATENT DOCUMENTS 4,395,202 A * 7/1983 Tell ..... 417/169
4,466,778 A * 8/1984 Volkmann ..... 417/174
4,759,691 A 7/1988 Kroupa
4,790,054 A * 12/1988 Nichols ..... 29/156
4,880,358 A 11/1989 Lasto
5,169,293 A * 12/1992 Yamamoto ..... 417/179
5,228,839 A * 7/1993 Peterson et al. ..... 417/174
5,683,227 A 11/1997 Nagai et al.
6,155,795 A * 12/2000 Schmalz ..... 417/151

* cited by examiner

*Primary Examiner*—Teresa Walberg
*Assistant Examiner*—Vinod D Patel
(74) *Attorney, Agent, or Firm*—Young & Thompson

(57) ABSTRACT

An ejector includes two or more nozzles arranged in series. A stream of air fed at high velocity through the nozzle is used to create a negative pressure in an outer, surrounding space. The surrounding space is in flow communication with at least one slot located between the nozzles. The nozzles are coupled together and assembled into an integrated nozzle body having at least one flexible valve member integrally arranged within the nozzle body to cover the flow communication with the surrounding space upon reaching a certain, desired pressure difference between the surrounding space and the atmosphere.

5 Claims, 3 Drawing Sheets

FIG 2
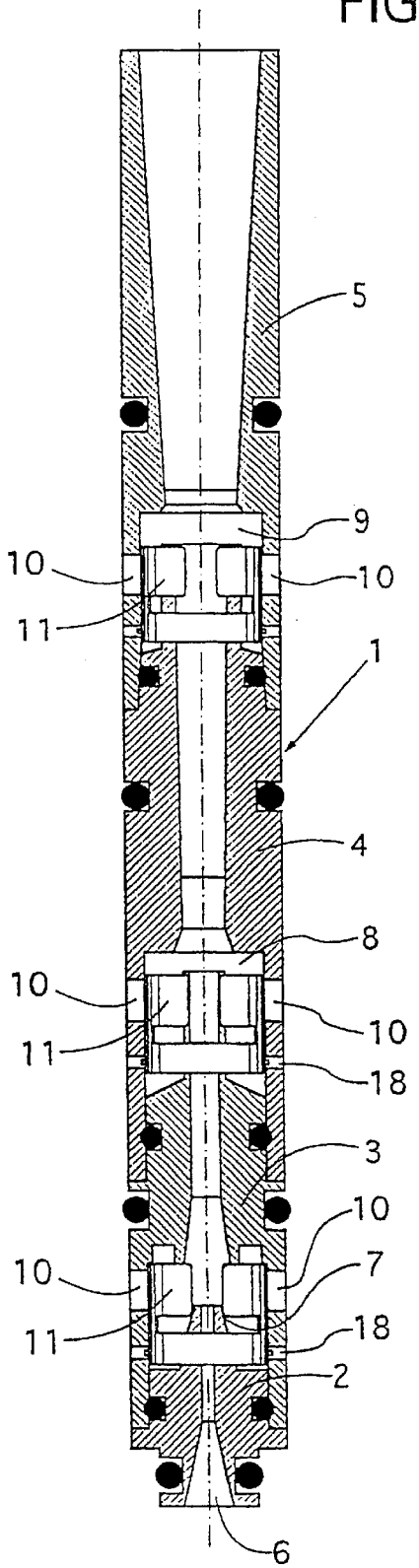
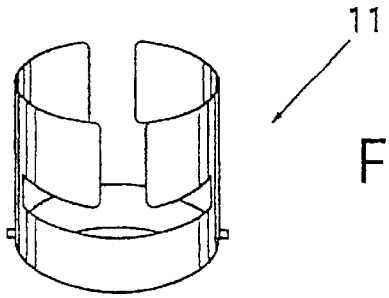
FIG 3
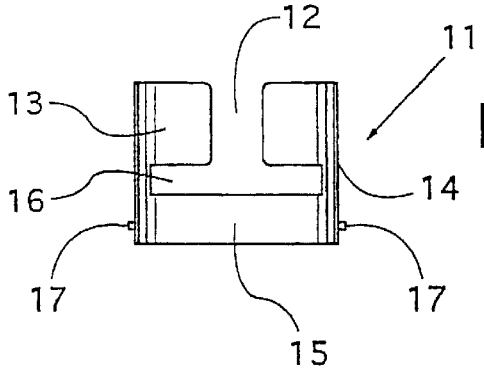
FIG 4

VACUUM EJECTOR PUMP

BACKGROUND OF THE INVENTION

The present invention relates to a vacuum pump or ejector, which is used for generating a negative pressure in a medium used for transportation or lifting, e.g., and more particularly to a vacuum pump having a nozzle body with at least one integrated valve member.

Pumps for generating a vacuum using overpressure are known in the art, see for example FIGS. 1*a*–1*d* of the appended drawings. Ejectors of the intended type, so called multistage ejectors, usually comprise two or more nozzles arranged in series within a house, wherein a surrounding space such as a chamber is associated to each respective nozzle, which extends through the partition wall between adjacent chambers. The nozzles present a through-channel with gradually increasing, sectional opening area, through which a stream of air with high velocity is fed to carry, through a slot located between the nozzles, air or other medium in the surrounding chamber and generate therein a lowering of the pressure.

When three or more nozzles are coupled in a series, the respective chamber is commonly in flow communication with a common or outer space, which has coupling means for connecting the vacuum pump to external equipment. A non-return valve in the form of e.g. a flexible tongue is arranged in the flow path to prevent leakage between the outer space and that chamber which, upon a certain difference in pressure, ceases to be active for further lowering of the pressure.

Ejectors of this known construction may be formed with nozzles coupled in series, with different efficiency characteristics in order to provide both a high vacuum flow and a low vacuum level in one ejector.

SUMMARY OF THE INVENTION

It is the object of the invention to provide an improved ejector of the above type, which permits greater flexibility and freedom of choice when built in with equipment for different applications wherein a space is to be evacuated or vacuum to be used for transportation or lifting. The ejector according to the invention also permits simplified assembly and disassembly in service and maintenance.

BRIEF DESCRIPTION OF THE DRAWINGS

The invention will be described in more detail below with reference to the appended drawings, in which FIGS. 1*a*–1*d* schematically show a multistage vacuum pump or ejector according to the state of the art, FIG. 2 shows, in a longitudinal cross-section, a preferred embodiment of a nozzle body forming part of the ejector according to the invention, FIG. 3 shows a valve member incorporated in the ejector, in a perspective view, FIG. 4 shows the valve member of FIG. 3 in a lateral view.

DETAILED DESCRIPTION OF THE PREFERRED EMBODIMENTS

FIGS. 1*a*–1*d* show schematically, in four cross-sectional views, a known ejector at gradually increased vacuum levels in an outer space.

Figure 1A:
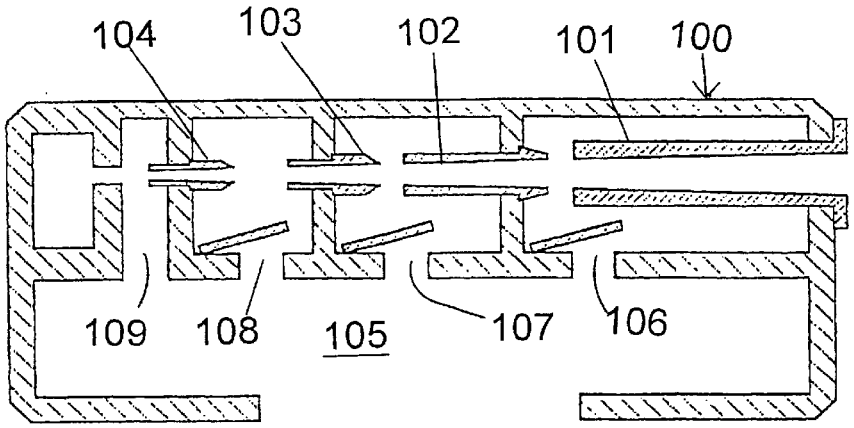
FIG 1a (Prior Art)
Figure 1B:
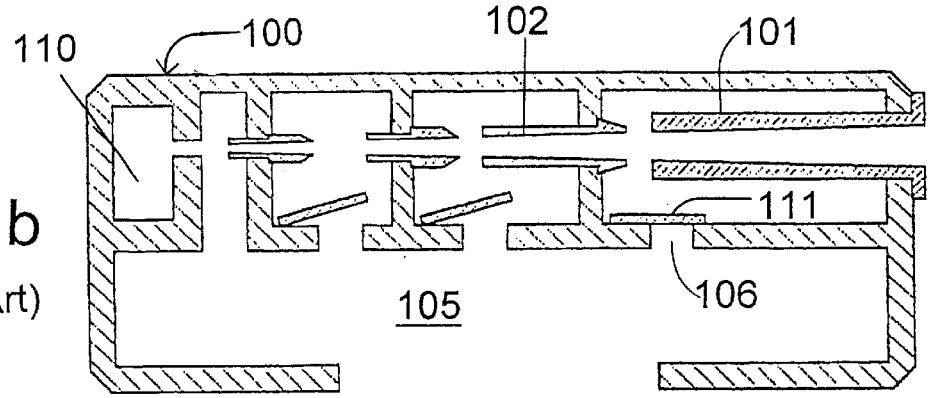
FIG 1b (Prior Art)
Figure 1C:
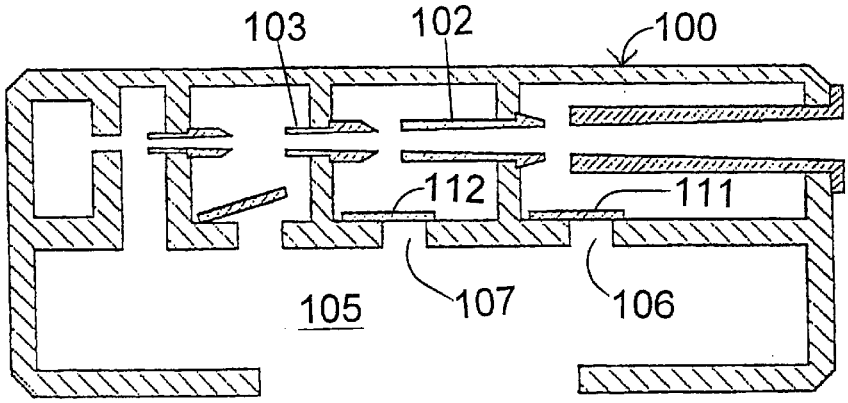
FIG 1c (Prior Art)
Figure 1D:
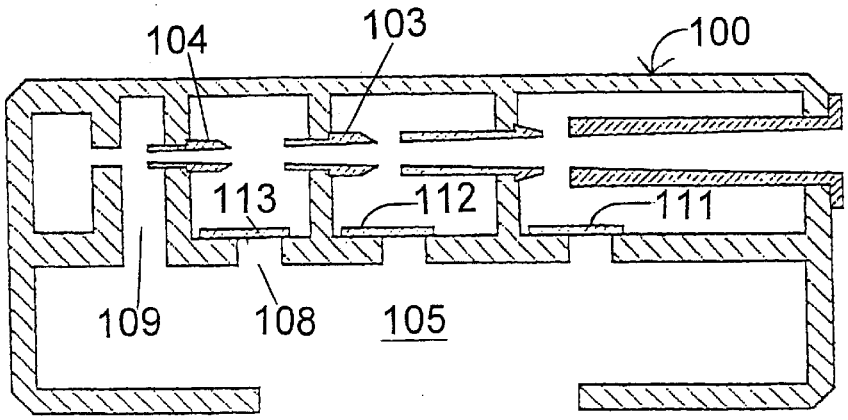
FIG 1d (Prior Art)

The prior art ejector of FIGS. 1*a*–1*d* comprises a housing 100, wherein ejector nozzles 101, 102, 103 and 104 are supported in series with intermediate gaps separately communicating with an outer chamber 105 via ports 106, 107, 108 and 109, respectively. In FIG. 1*a* the ejector 100 is shown in a non-operating mode. In FIG. 1*b*, the ejector is driven by air that is accelerated into a channel 110 and directed through the nozzles from the left hand side to the right hand side of the drawing, whereby a pressure fall is generated in the gaps between the nozzles. In FIG. 1*b*, the total pressure fall over the gaps has reduced the pressure in the outer chamber 105 to a level that is lower than the pressure fall in the gap between nozzles 101 and 102, causing a flap valve 111 to close the port 106. In FIG. 1*c*, the pressure in the outer chamber 105 is reduced to the extent that a valve 112 closes communication through port 107. In FIG. 1*d*, also port 108 is closed by a valve 113, such that the outer chamber 105 is maintained at a pressure level determined by the pressure fall produced by nozzle 104 which communicates with the chamber 105 through the port 109. The multi stage ejector of FIGS. 1*a*–1*d* is connected via port 114 to external equipment, driven by the ejector.

In FIG. 2 and the following drawings, the ejector according to the invention is generally indicated with the reference numeral 1. The ejector 1 in the embodiment shown in FIG. 2 comprises four jet-shaped nozzles 2, 3, 4 and 5.

The nozzles 2–5 comprise a through-channel 6 with gradually increasing, cross-sectional opening area. The nozzles are arranged in a series with a slot 7, 8 and 9, respectively, between them, the slots and the jets being dimensioned according to considerations of the person skilled in the art to give the ejector the desired efficiency characteristics.

The nozzles 2, 3, 4 and 5 are designed for assembly to form an integrated nozzle body 1.

For this purpose, the nozzles are formed in the opposed ends thereof with shoulders and projecting flanges or with casings, by which the assembled nozzles are spaced to form slots 7, 8 and 9 of suitable width and opening area. Alternatively, the nozzles may be formed with threads for threaded engagement, or with other coupling means, to be assembled into an integrated body.

In connection with the coupling areas of the nozzles and adjacent to the slots 7, 8 and 9, through openings 10 are arranged in the wall of the nozzle body. The openings 10 provide flow communication with an outer space (like the chamber V in FIG. 5) surrounding the nozzle body 1. Valve members 11 are arranged, in a manner which will be described below, to cover and to open, respectively, the flow communications 10, the number of which may vary within the scope of the invention.

The valve members 11 are arranged to prevent, in the way of non-return valves 11, leakage from the air flow in the channel 6 and to the surrounding space in a situation, where the outer space holds a pressure which is lower than the pressure of the air flow through the slot 7, 8 or 9, respectively, associated with the valve members. The valve member 11 may preferably be produced from a flexible material, such as natural rubber, synthetic rubber or plastic.

The valve members 11 are accommodated for integration with the nozzle body 1.

In the connection areas of the nozzles, assembled in a series, valve seats are formed on the inner wall of the nozzle body and adapted for receiving a respective valve member 11 in the area of the flow communications 10 and adjacent to the slots. The valve member 11 extends inwardly of the openings 10 to lie, in a covering position, against the inner wall of the nozzle body 1 and to cover the opening with a section of the valve member.

In the preferred embodiment, the nozzle body 1 has a rotationally symmetric shape. Thus, the valve member 11 is of cylindrical shape and runs concentric with the airflow through the channel 6.

The detailed design of the valve member may naturally be varied within the scope of the invention. In the embodiment shown, the valve member 11 comprises a pair of axial slots 12, in such way that a pair of semi-circular tongues 13 are formed in the flexible and covering end of the valve member, see FIGS. 3 and 4. Further, a pair of radial slots 16 are formed inwardly of the tongues 13, so that these connect only through one respective bridge 14 to a cylindrical base section 15 of the valve member 11. The base section 15 may, as in the shown embodiment, comprise heels or pins 17, which in the receiving position of the valve member engage with corresponding recesses 18, formed in the wall of the nozzle body in order to secure the valve member. Naturally, the valve member may be secured in the nozzle body also in other ways without departure from the concept of the invention.

Figure 5:
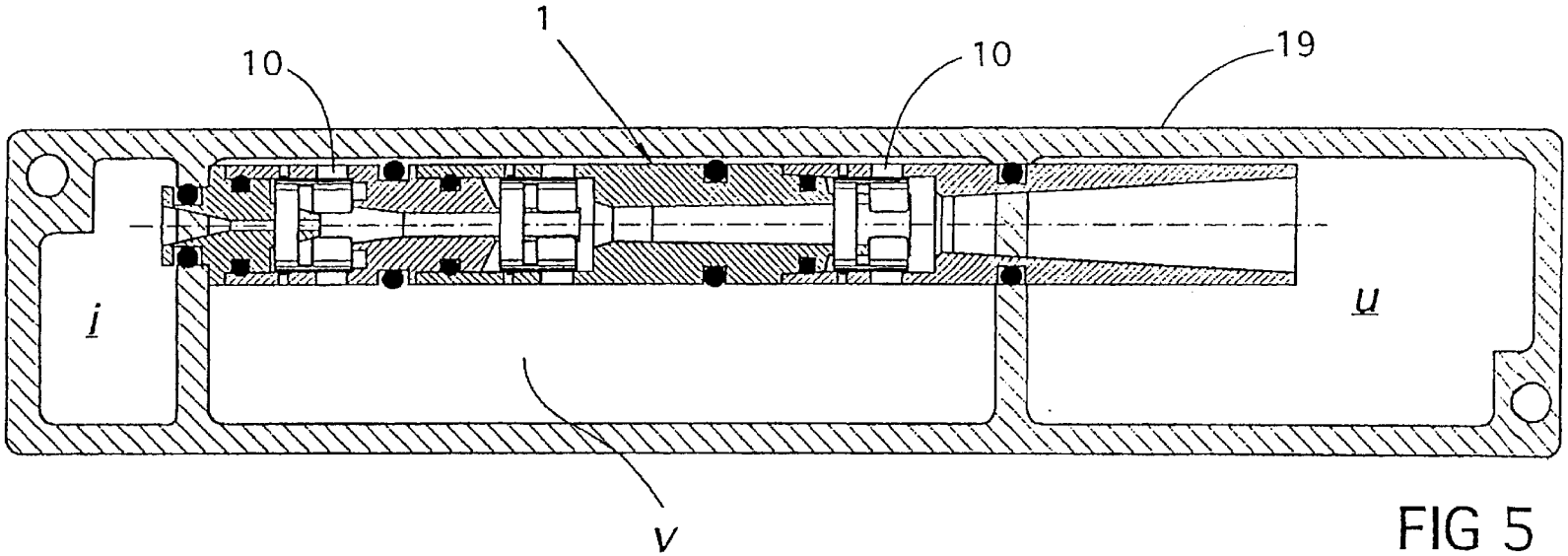
FIG. 5 shows the nozzle body accommodated in a housing.

With reference to FIG. 5, an ejector according to the invention is shown comprising a nozzle body 1 with integrated valve members and mounted in a housing 19. The nozzle body 1 extends, from its inlet end, between an inlet chamber I and an outlet chamber U wherein the nozzle body opens with its outlet end, and passes through a surrounding, outer space V. Via the openings 10, the outer space V is in flow communication with the channel 6 of the nozzle body. The outer space or chamber V, from which evacuation occurs upon feeding an air flow at high velocity through the channel 6, is open to all the flow communications 10 of the nozzle body 1. In the drawing, an additional nozzle body is indicated in broken lines. This second nozzle body may be operated in parallel with the nozzle body 1. It will be appreciated, that ejectors may be formed with housings 19 for mounting of more than two nozzle bodies 1, operating in parallel, according to the invention.

Figure 6:
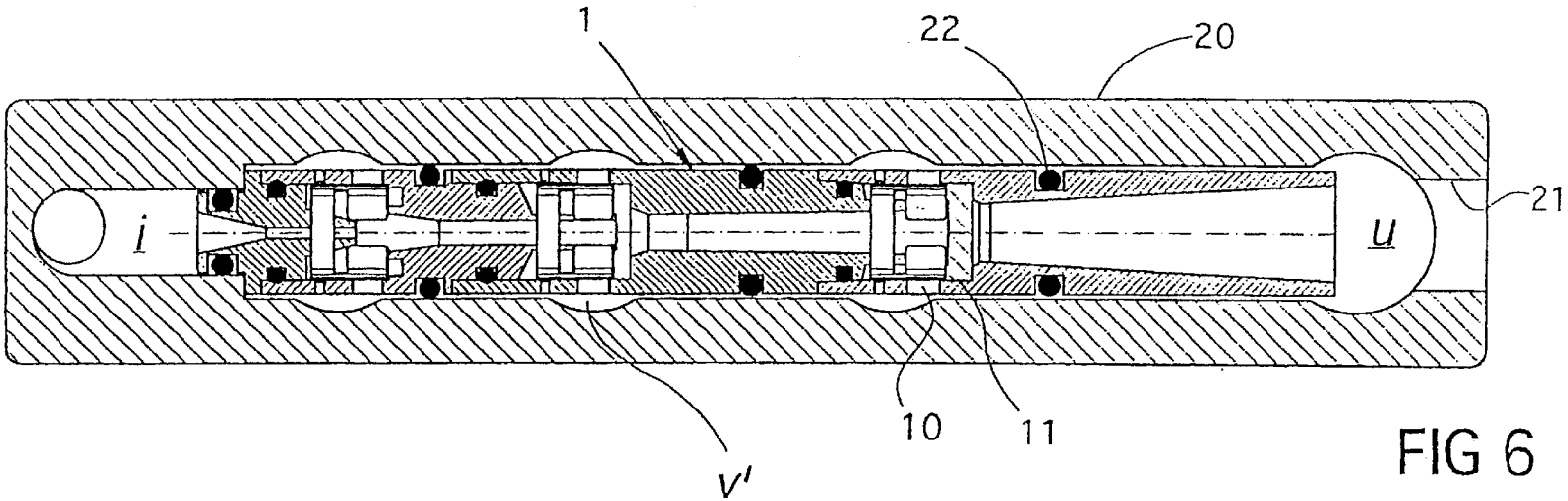
FIG. 6 shows the nozzle body according to the invention mounted in a machine element.

Referring now to FIG. 6 there is shown an ejector mounted in a machine element 20, and comprising a nozzle body 1 with integrated valve members according to the invention. The nozzle body 1 extends from an inlet chamber I to an outlet chamber U and passes an enclosing space V', which is evacuated through the operation of the ejector. The nozzle body 1 is tightly fitted into a bore 21, e.g. formed as a blind hole 21, and seals against the inner wall of the bore through O-rings 22. The evacuated space V', and if desired also the inlet and outlet chambers I and U, respectively, may be provided as transverse bores which intersect the bore 21. In the embodiment shown, the space V' is comprised of three individual spaces V', separated by the seals 22. However, it will be noted that with another design of the accommodation and sealing of the nozzle body in the bore 21, the individual chambers V' may also be in mutual flow communication through the circular gap between the nozzle body 1 and the wall of the bore 21, in applications where this would be desired.

The invention has here been described with reference to an embodiment wherein both the nozzles 2, 3, 4, 5 and the valve members 11 are rotationally symmetric bodies. While this design is the most preferred embodiment in aspects of production, maintenance and construction for different applications, the invention is in no way to be limited to ejectors having the shown design, as it is obvious to those skilled in the art that many of the advantages of the invention may also be implemented in nozzle bodies of other sectional shapes, at least externally. The claimed scope of protection is thus drafted to accommodate also such considered embodiments that are not specifically shown here but lie within the knowledge of those skilled in the art to practice with the guidance of the above description.

What is claimed is:

1. An ejector comprising at least two nozzles assembled in series, wherein a stream of air fed through the at least two nozzles at high velocity is used to create, in an outer, surrounding space a negative pressure, the surrounding space being in flow communication with at least one slot located between the at least two nozzles, wherein the at least two nozzles have means to be coupled together into an integrated, rotationally symmetric nozzle body, and that the flow communication is arranged in a wall of the rotationally symmetric nozzle body.

2. An ejector according to claim 1, further comprising at least one flexible valve member for covering the flow communication and arranged integrally in the nozzle body so as to extend concentrically with the stream of air fed through the at least two nozzles.

3. An ejector according to claim 2, wherein the at least two nozzles which are coupled together to form the integrated nozzle body with the at least one slot formed between the at least two nozzles, has the at least one flexible valve member arranged in connection with each of the at least one slot, respectively, the valve member being axially slotted to present at least one semi-circular tongue for covering the flow communication.

4. An ejector according to claim 2, wherein the at least two nozzles are formed in opposing ends thereof to be assembled into the integrated nozzle body with a through channel of gradually increasing, sectional opening area, the nozzle body having the at least one slot, which opens into the through channel and is in flow communication with the surrounding space, and at least one seat for the valve member covering the flow communication.

5. An ejector according to claim 1, wherein the at least two nozzles have a rotationally symmetric outer and inner cross sectional shape, assembled to form the integrated nozzle body, wherein the at least one valve member is integrally received in the nozzle body in order to cover, upon a reached pressure difference between atmosphere and an outer space surrounding the nozzle body, the flow communication between the surrounding outer space and a channel through the at least two nozzles in the region of the at least one slot formed between the assembled at least two nozzles in the nozzle body, said at least one valve member sealing against an inner wall of the nozzle body.

* * * * *